US005495311A

United States Patent [19]

Lant et al.

[11] Patent Number: 5,495,311

[45] Date of Patent: Feb. 27, 1996

[54] AUTOMATIC LOADING DEVICE FOR PHOTOGRAPHIC FILMS, IN DEVELOPING MACHINES

[75] Inventors: Danny Lant, Udine; Giosuè Franci, Pordenone, both of Italy

[73] Assignee: San Marco Imaging S.r.l., Pordenone, Italy

[21] Appl. No.: 260,902

[22] Filed: Jun. 15, 1994

[30] Foreign Application Priority Data

Jun. 16, 1993 [IT] Italy ..... PN93A0040

[51] Int. Cl.[6] ..... G03D 13/06

[52] U.S. Cl. ..... 354/310

[58] Field of Search ..... 354/297, 310–314, 354/319–321, 354; 156/502, 506, 353; 355/40, 41

[56] References Cited

U.S. PATENT DOCUMENTS 4,411,725 10/1983 Siegel et al. ..... 354/314 X
4,543,151 9/1985 Aldo ..... 156/502
4,888,613 12/1989 Zangenfeind et al. ..... 355/41
4,894,674 1/1990 Radov ..... 354/354 X
5,227,827 7/1993 Murakami ..... 354/333
5,311,232 5/1994 Dech et al. ..... 354/298

*Primary Examiner*—D. Rutledge
*Attorney, Agent, or Firm*—Wenderoth, Lind & Ponack

[57] ABSTRACT

A device for automatically loading a roll of film into a developing machine includes an external casing and a sliding drawer set in motion by a drive. The drawer has a longitudinal gap. A shuttle housing the roll of film, a product bar code reader, elements by which the shuttle is guided, respectively, in a longitudinal direction and a transverse direction, and a cutter by which the end of the film is trimmed square, are disposed to one side of the gap. A sheath accommodating the film leader is disposed on the other side of the gap. The casing also houses a vertical baffle supporting reels of adhesive tape. As the table slides into the casing, the film is automatically trimmed, brought into correct matching association with the leader and then spliced by portions of adhesive tape applied to both sides of the film and the leader.

17 Claims, 5 Drawing Sheets

AUTOMATIC LOADING DEVICE FOR PHOTOGRAPHIC FILMS, IN DEVELOPING MACHINES

BACKGROUND OF THE INVENTION

The present invention relates to a device that will allow photographic films to be automatically loaded into developing machines.

The prior art embraces developing machines by which photographic films are processed continuously and automatically.

Initially, these machines were employed principally in professional photographic laboratories for developing large quantities of photographic material.

Thereafter, it became a trend for such machines to be likewise utilized in non-specialist commercial enterprises, for example large stores or supermarkets. This trend has given rise to a demand for machines with increasing levels of automation, which require minimal manning and which can be operated easily even by staff possessing no special skills or with no particular training.

Nonetheless, the operation of loading photographic film into current developing machines is effected normally by hand and brought about conventionally in one of two ways, namely, without or with the aid of a take-up device commonly referred to as a leader. In the first instance, the end of the film is trimmed by being manually cut transversely, the film is then inserted directly into a suitable device by which it is drawn into the machine, and then the film is fed through the chemical treatment baths of the machine and the successive drying chamber by rollers of a flexible material which engage the lateral edges of the film. In the second instance, by contrast, the end of the film is joined to the leader by which the film is then drawn into the machine and is fed along the selfsame path in a conventional manner.

The first solution, while simple, requires that the film be trimmed with a certain precision. When this is done, the roll of film to be developed must be positioned in a suitable light-excluding container with the trimmed end inserted in a suitable gripping device in readiness for introduction into the machine. Then, finally, the light-excluding container is closed and the operating cycle can begin.

If the insertion step is not effected with sufficient precision, the strip of film may run askew to a greater or lesser degree in relation to the prescribed path, or alternatively, the lateral edges of the film can become damaged due to various possible causes which likewise results in the strip of film subsequently deviating from the prescribed path. Consequently, the film itself will suffer irreparable damage.

The second solution on the other hand is found normally to be laborious and difficult: indeed the operator must join the initial part of the roll of photographic film to the leader by which it is guided into the developing machine, and generally this operation requires that the take-up tongue afforded by the roll of film be cut by hand initially in such a way as to obtain a faultlessly squared end which then must be matched with the tail end of the leader and secured thus by the application, likewise by hand, of suitable lengths of adhesive tape. If the end of the film in question is not correctly cut or not accurately joined to the tail end of the leader, the film will also be drawn askew into the developing machine and can stray from its prescribed path, consequently suffering damage.

SUMMARY OF THE INVENTION

It would thus be desirable, and such is the main object of the invention, to provide an automatic device that will load photographic film into developing machines with precision, i.e. in a correct manner and without the need for complicated manual operations.

An additional object of the invention is to provide a device of the aforementioned type in a compact package easily incorporated into conventional developing machines currently in use.

To achieve these and other objects, the invention provides a device having an external casing, and a sliding drawer movable into and out of the casing. The drawer defines a longitudinal gap. A shuttle housing the roll of film, a bar code reader, longitudinal and transverse tracks for the shuttle, and a film cutter are disposed to one side of the gap. A sheath for accommodating the film leader is disposed on the other side of the gap. An adhesive tape dispenser is mounted to a vertical baffle within the casing.

BRIEF DESCRIPTION OF THE DRAWINGS

Other objects, features and advantages of the device according to the invention will emerge more clearly from the following description of a preferred embodiment of the present invention, and from the accompanying drawings, in which.

DETAILED DESCRIPTION OF THE PREFERRED EMBODIMENT

Figure 1:
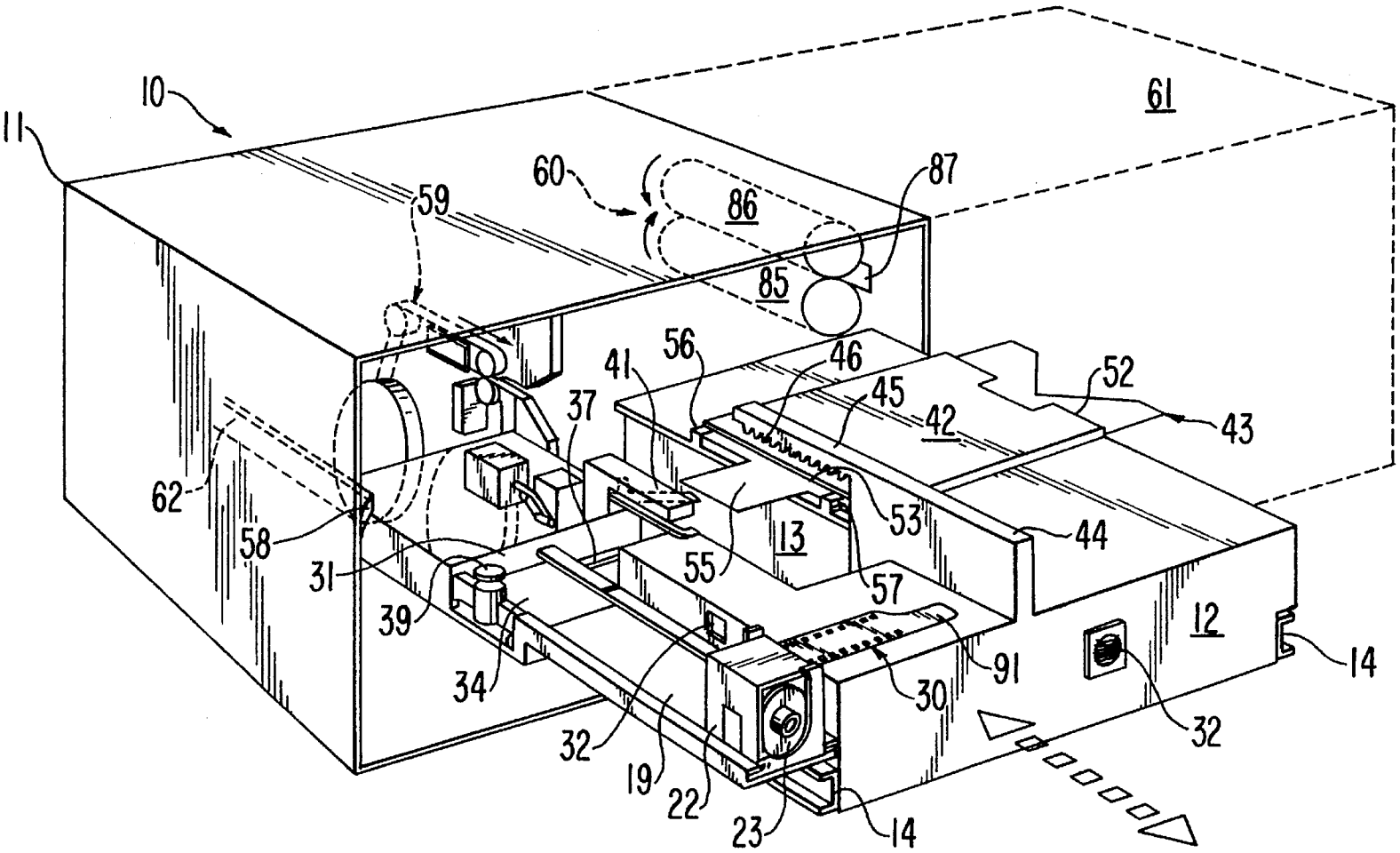
FIG. 1 is a perspective view of the device according to the present invention.

With reference in particular to FIG. 1, the device 10 according to the invention consists substantially of an external casing 11, and a drawer 12 capable of sliding horizontally in relation to the casing 11.

The external casing 11 has a boxlike structure of compact dimensions, and is thus easily associated with any developing machine currently obtainable through commercial channels.

The drawer 12 has the shape of a parallelepiped with a rectangular base, and defines a full depth gap 13 on the side directed toward the interior of the casing 11. The gap 13 extends longitudinally for some three quarters of the length of the drawer 12.

Figure 4:
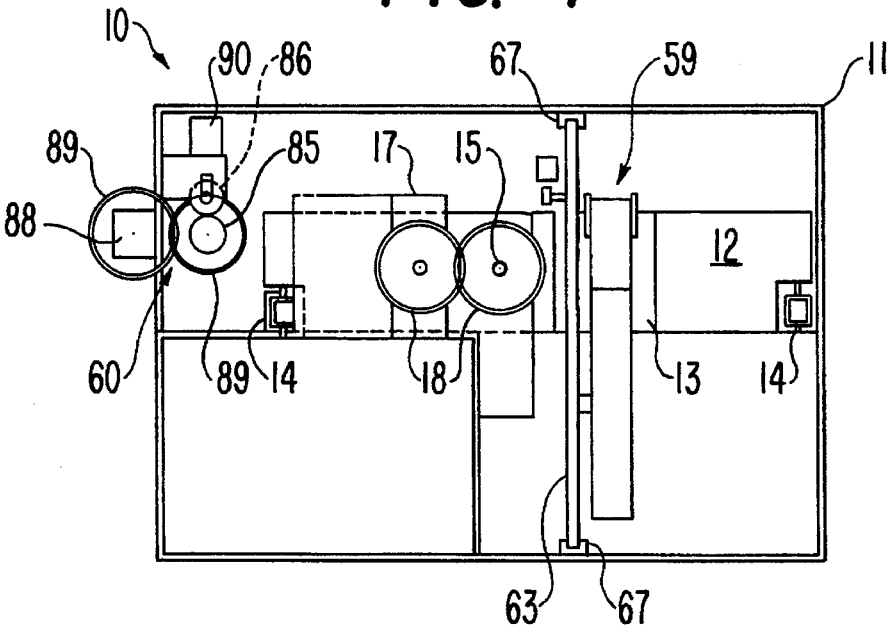
FIG. 4 is a view of the device taken from the rear of the casing in which it is placed.
Figure 7:
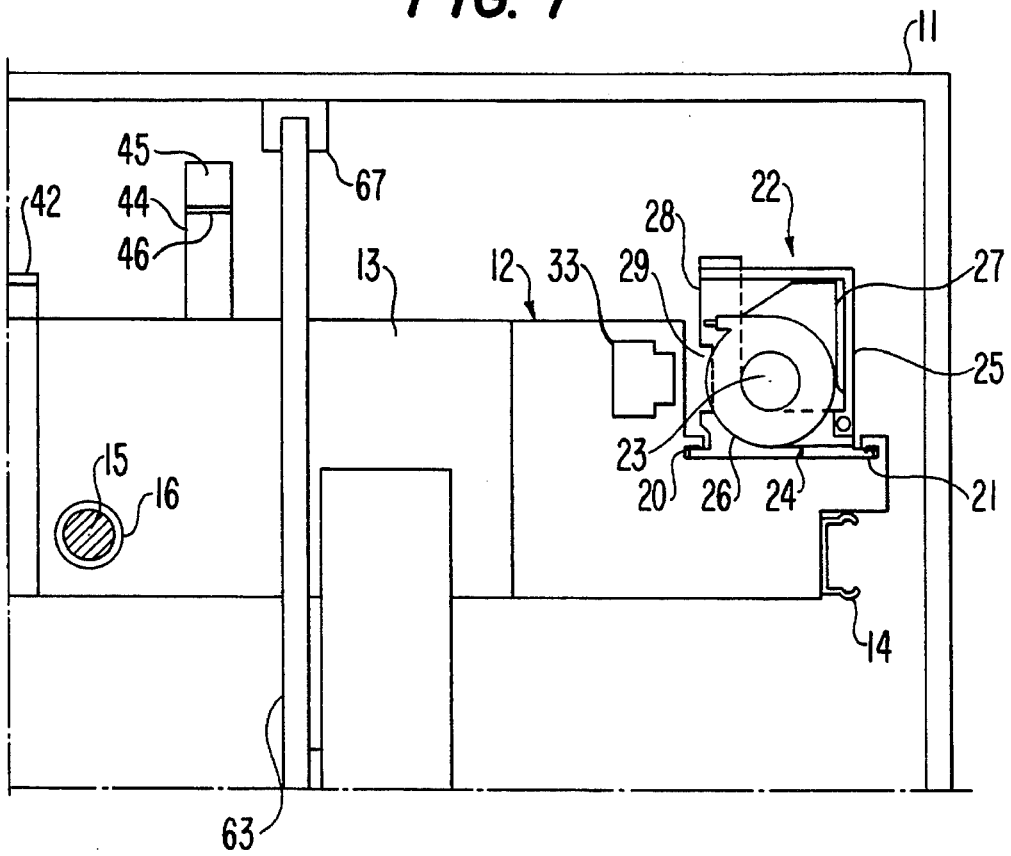
FIG. 7 is a cross-sectional view of means by which a roll of film is accommodated and translated thus in a longitudinal direction.

The sides of the drawer 12 are slidable along the walls of the casing 11 by way of precision telescopic runners 14 gliding on ball bearings. The drawer 12 is set in motion by a lead screw 15 (FIGS. 4 and 7) mounted rotatably to the casing 11 and coupled with a lead nut 16 incorporated into the drawer. The screw 15 is driven by a geared motor 17, to which it is connected by way of gears 18 (FIG. 4).

Figure 8:
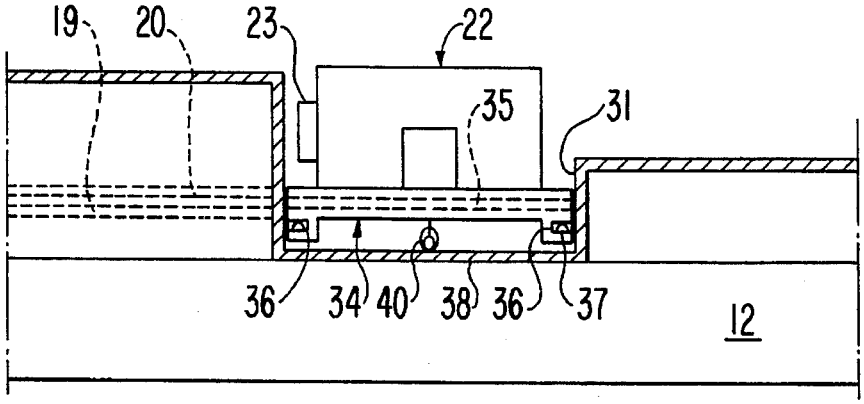
FIG. 8 is a cross-sectional view of means by which the roll of film is translated in a transverse direction.

Extending along one side of the drawer 12 and for some three quarters of its length is a shelf 19, projecting horizontally over a telescopic runner 14. The longitudinal edges of the shelf 19 (FIGS. 7 and 8) define two channels 20 which function to guide the flanged sliding edges 21 of a shuttle 22 in which the roll 23 of photographic film is accommodated. The shuttle 22 comprises a box-like housing created by the union of a base element 24 with a cover element 25, each having an L-shaped cross section. The cover element 25 is hinged to the base element 24 along a horizontal axis and is thus pivotable between an open position and a closed position.

The inside face of the base element 24 affords arcuate supports 26 (FIG. 7) on which the roll of film 23 is positioned with its axis parallel to the longitudinal axis of the drawer 12.

A suitably profiled metal leaf spring 27 associated with the inside face of the cover element 25 (FIG. 7) serves to retain the roll of film 23 resiliently in the correct position internally of the housing.

The vertically disposed wall of the base element 24 of the shuttle 22 is furnished with openings 28 and 29 respectively affording a passage to the photographic film 30 (FIGS. 1, 2 and 9) and exposing a bar code, applied to every roll, which identifies the physical and chemical specifications of the particular film. The lateral shelf 19 of the drawer 12 exhibits one open end, coinciding with the front face of the drawer 12, whereas the remaining internal end terminates at a vertical face 31 (FIGS. 1 and 2) presented by the body of the drawer 12. Approximately half way along the length of the shelf 19, the vertical side wall of the drawer 12 affords a window 32 (FIG. 1); at a point coinciding with this same window 32, the body of the drawer 12 houses an optical device 33 capable of reading the bar code carried by each roll of film.

At the internal stopped end of the shelf 19, the device comprises a carriage 34 occupying the same plane as the shelf 19 and furnished with longitudinal edges defining channels 35 (FIG. 8) identical to and aligned with the channels 20 of the shelf 19. The transverse edges of the carriage 34 define additional channels 36 (FIG. 8) designed to couple slidably with corresponding guides 37 projecting from the vertical walls of a transverse track 38 extending from the lateral shelf 19 to the gap 13 afforded by the drawer 12.

The outermost longitudinal side of the carriage 34 is fitted with a wheel 39 (FIGS. 1 and 2) rotatable about a vertical axis, the function of which will be described in due course. The underside of the carriage 34 is connected to the transverse track 38 by a return spring 40 (FIG. 8), the function of which likewise will be described in due course.

The top face of the drawer 12 carries a cutter 41 (FIGS. 1, 2 and 9) by which the photographic film 30 is cut square, a horizontal sheath 42 accommodating a leader 43 by which the film 30 is drawn forward, and a longitudinal ridge 44 which supports, at the end thereof closest to the casing 11, a horizontal arm 45. The underside of the arm forms a rack 46. The cutter 41 occupies a position at the innermost end of the transverse track 38 adjacent the gap 13 in the drawer 12.

The cutter 41 includes a first blade 47 (FIG. 9), fixed in a horizontal position, and a second blade 48 mounted pivotably in relation to the first blade 47. The pivotable blade 48 is operated in a conventional manner by an electromagnetic device 49, through the agency of a conventional mechanical coupling. Likewise, in a per se conventional manner, the cutter 41 also includes a transverse plate 50 which restrains the film 30 in a horizontal position ready for trimming, and a safety guard 51 serving to prevent accidental access to the blades 47 and 48.

The sheath 42 accommodating the leader 43 extends in a direction transverse to the longitudinal axis of the drawer 12 and coaxially with the transverse track 38 which guides the carriage 34.

The mouth 52 of the sheath 42 lies adjacent to one lateral edge of the drawer 12, whereas its rear end 53 lies adjacent to the gap 13 of the drawer 12, facing the transverse track 38 and the cutter 41. The sheath 42 is of such a length that the two take-up lugs 54 of the leader 43 will project from the mouth 52, for reasons to be described in due course. The rear end 53 of the sheath 42 is partially open so that the tail end 55 of the leader 43, which must be spliced to the photographic film 30, is able to emerge from the sheath 42. Also at the rear end 53 of the sheath 42 are disposed a mechanical stop 56 and a proximity sensor 57, the functions of which are, respectively, to ensure correct positioning of the leader 43 and to enable operation of the loading device only after the leader 43 has been correctly inserted in the sheath 42.

The longitudinal ridge 44 supporting the rack 45 extends inward from the front face of the drawer 12 and terminates at a point close to the sheath 42 containing the leader 43. The arm 45 occupies a position adjacent the gap 13 in the drawer 12 and above the sheath 42 accommodating the leader 43, and performs a function that will be described in due course.

Figure 2:
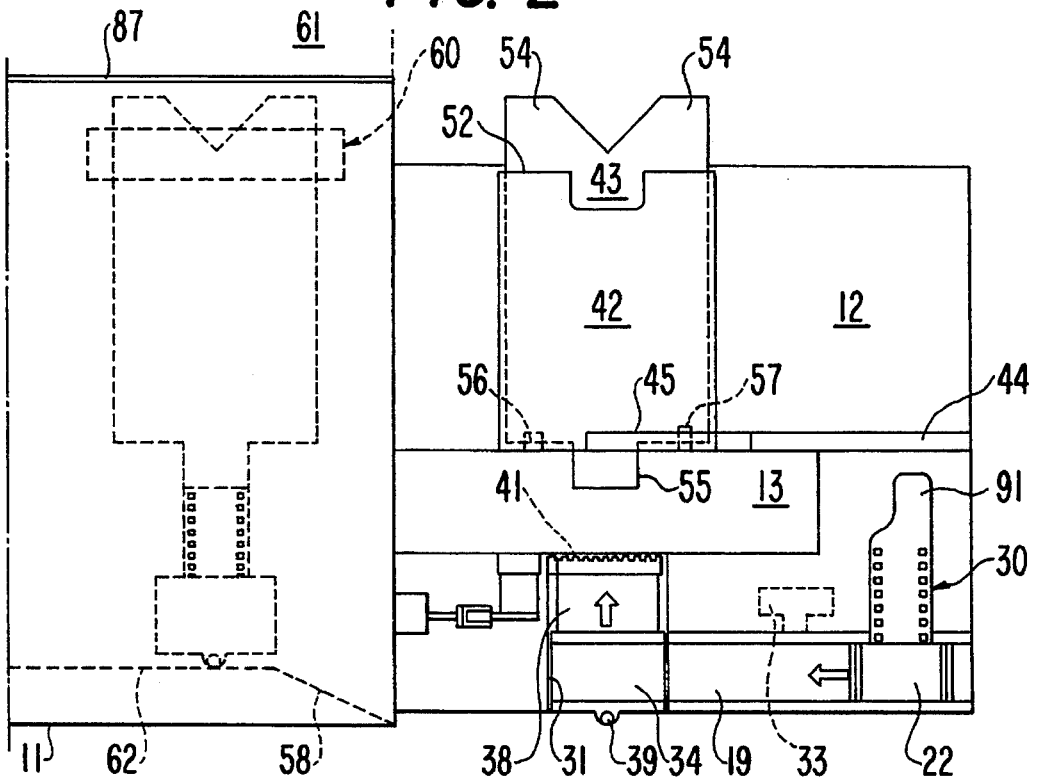
FIG. 2 is a plan view of part of the device according to the invention.

Internally of the casing 11, the device 10 further comprises an angled surface 58 (FIGS. 1, 2 and 3), a removable splicing mechanism 59 (FIGS. 1, 4, 5 and 6), and a loading mechanism 60 by which the film 30 is directed into the developing machine 61 (indicated by phantom lines in FIGS. 1 and 2).

The angled surface 58 extends obliquely from the vertical wall of the casing 11 toward the interior of the casing 11 to the point of merging with a rectilinear surface 62 disposed parallel to the selfsame vertical wall of the casing 11.

The angled surface 58 is designed to interact with the vertically revolving wheel 39 of the carriage 34 in a manner to be described in due course.

The splicing mechanism 59 includes a vertical baffle 63 (FIG. 5) carrying two reels 64 loaded with adhesive tape, and a guillotine type of cutter device 65 actuated by a solenoid 66.

The longitudinal edges of the vertical baffle 63 are slidably accommodated in corresponding horizontal channels 67 having C-shaped profiles (FIGS. 4 and 7) secured, respectively, to the top and bottom internal faces of the casing 11.

The splicing mechanisms 59 can be slid from the casing 11 by pulling on a handle 68 (FIG. 5) that projects outward from the vertical front edge of the baffle 63.

The top section of the vertical baffle 63 defines a slot 69 extending longitudinally from the vertical front edge to a rectangular opening 70. The initial part of the longitudinal slot 69 is defined by splayed edges 71 designed to function as a funnel. These splayed edges 71 are formed by entry plates 72.

Figure 5:
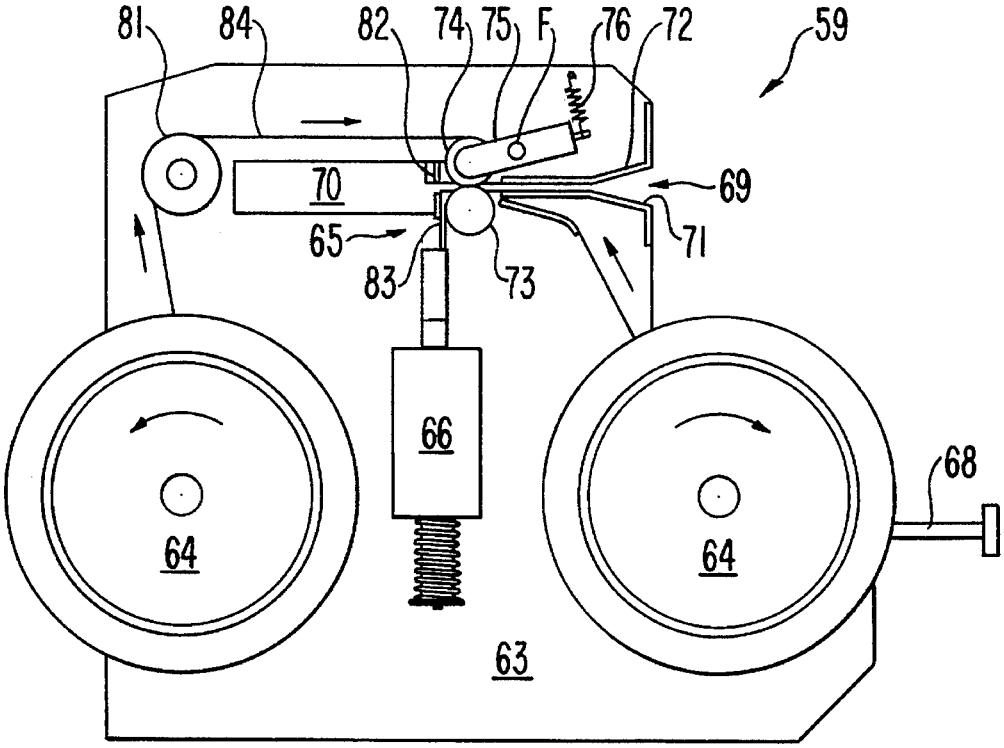
FIG. 5 is a side view of a vertical baffle supporting means for dispensing adhesive tape.
Figure 6:
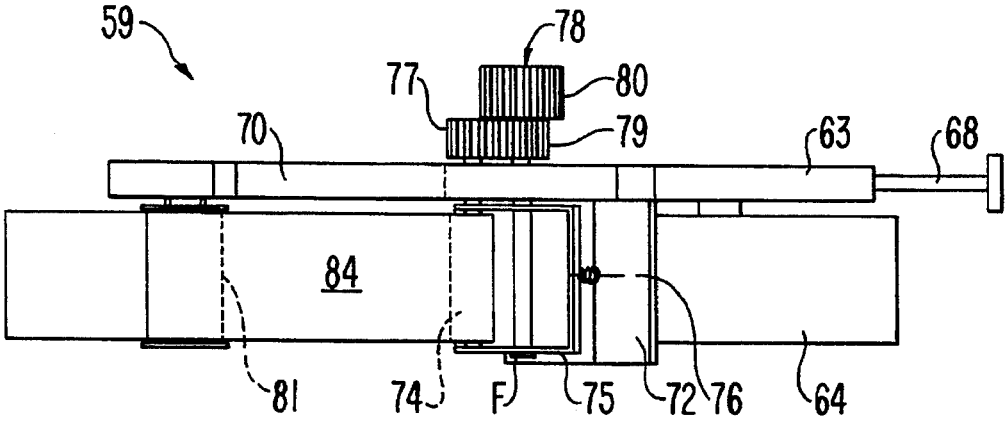
FIG. 6 is a plan view of the baffle shown in FIG. 5.

Two pinch wheels 73 and 74 disposed one above the other and mounted to rotate about respective horizontal axes coact within a space located at the transition of the slot 69 into the rectangular opening 70. The lower wheel 73 is freely rotatable about a fixed axis. The upper wheel 74 is mounted rotatably to the end of a rocking lever 75 pivotable about a fulcrum F. As indicated in FIG. 5, the lever 75 is biased by a spring 76 to rotate in such a direction as to force the upper wheel 74 against the lower wheel 73.

The upper wheel 74 is rotated in a clockwise direction by two gears 77 and 78 (FIG. 6) mounted rotatably to the opposite side of the vertical baffle 63.

The first gear 77 is mounted coaxially with the upper wheel 74. The second gear 78 is coaxial with the fulcrum F. The second gear 78 includes an external toothed portion 80, and an internal toothed portion 79 the diameter of which is smaller than that of an external toothed portion 80.

The internal portion 79 of smaller diameter meshes with the first gear 77, whereas the function of the larger diameter external portion 80 is to mesh with the rack 46 formed by the arm 45 extending from the drawer 12.

The two reels 64 carrying the adhesive tape are freely revolving, and are mounted to the baffle 63 so as to rotate about respective horizontal axes.

The adhesive tapes are directed between the two pinch wheels 73 and 74, with the aid of an intermediate guide wheel 81 in the case of the uppermost tape, in such a way that their adhesive surfaces are mutually opposed. The cutter device 65 is disposed vertically between the pinch wheels 73–74 and the rectangular opening 70. In a per se conventional manner, the cutter device 65 comprises one fixed blade 82 and one moving blade 83. The moving blade 83 is shifted by the solenoid 66 toward the fixed blade 82 in such a way as to sever the tapes positioned between them, and is returned by appropriate means to an at-rest position when the solenoid 66 is de-energized. The loading mechanism 60 by which the film 30 is fed into the developing machine 61 comprises two horizontal pinch rollers 85 and 86 positioned one above the other alongside a port 87 communicating with the machine 61. The top roller 86 is freely revolving, and rotatable about a movable axis. The bottom roller 85 is rotated by a geared motor 88, to which it is coupled mechanically by way of transmission gears 89.

The axis of rotation of the top roller 86 is able to slide vertically between a feed position, in which the top roller 86 impinges the bottom roller 85, and a standby position in which the top roller 86 is elevated above the bottom roller 85.

The elevation of the top roller 86 is brought about by energizing a solenoid 90 connected mechanically to the axis of rotation of the roller 86 (FIG. 4).

The operation of the loading device 10 according to the invention is as follows.

The roll 23 of photographic film 30 to be developed is inserted in the shuttle 22, which will be lying at the outermost end of the lateral shelf 19 of the drawer 12. The shutter 22 is positioned such that the openings 28 and 29 affording passage to the film and exposing the bar code to the reader are directed toward the drawer 12.

Figure 3:
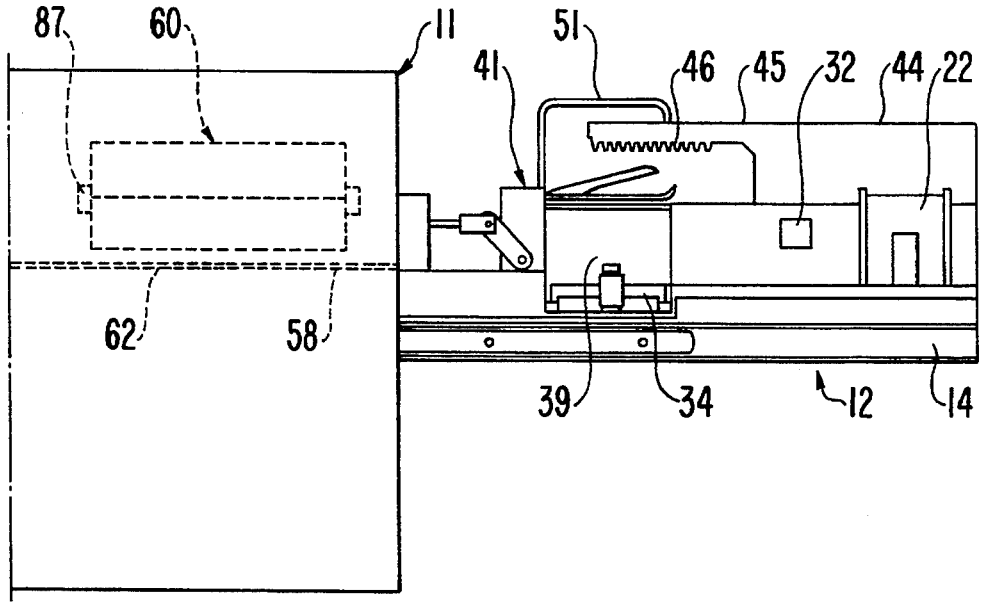
FIG. 3 is a side view of the part of the device illustrated in FIG. 2.

The short initial length 91 of film 30, which generally will be shaped to facilitate its loading onto the take-up spool of a camera, is flattened transversely over the top face of the drawer 12 (FIGS. 1, 2 and 3).

Figure 9:
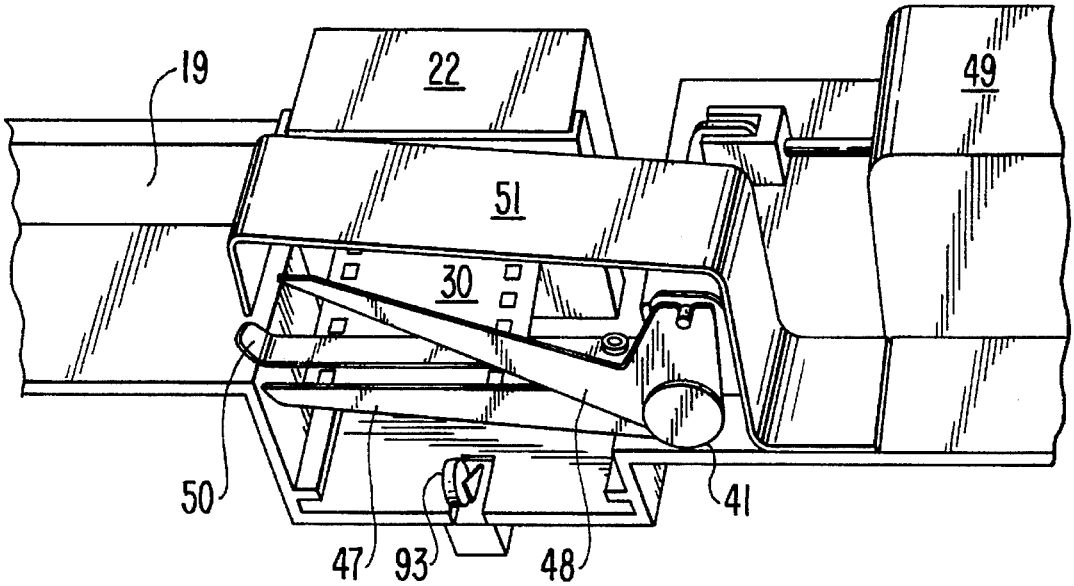
FIG. 9 is a perspective view of means for trimming the photographic film.

The operator now slides the shuttle 22 along the full length of the lateral shelf 19 and onto the carriage 34 at the innermost end of the shelf 19. The initial length 91 of film 30 emerging from the roll 23 is at this point positioned between the two blades 47 and 48 of the cutter 41 (FIG. 9).

As the shuttle 22 slides along the lateral shelf 19, the roll 23 passes in front of the window 32 and the optical device 33 will read the bar code containing the specifications of the film 30 to be developed. Given the requisite compatibility between the film 30 and the developing machine 61, the bar code reader 33 generates a signal to enable the loading procedure.

Use of the loading device 10 also requires that the operator insert the leader 43 into the sheath 42, the effect of which is to switch the relative proximity sensor 57 to a position enabling operation of the device 10.

Having completed the simple manual operations described above, the operator activates the device 10 by pressing a button 92 located on the front face of the drawer 12. With the device 10 in operation, the leading edge of the film 30 will be trimmed square by the cutter 41 and the lead screw 15 begins turning in the nut 16 to move the drawer 12 into the casing 11. As the drawer 12 moves further into the casing 11, the vertically disposed wheel 30 of the carriage 34 enters into contact with the angled surface 58. The angled surface 58 cause the carriage 34 to move along the transverse track 38 to the point at which the trimmed end of the film 30 is caused to coincide and match up with the tail end 55 of the leader 43, which will be projecting from the sheath 42 (the positions in question are indicated by phantom lines in FIG. 2).

With the drawer 12 still advancing, the matched edges of the film 30 and the leader 43 enter the longitudinal slot 69 of the splicing mechanism 59 and are brought into contact with the mutually opposed ends of the two adhesive tapes 84.

Thereupon, the edges of the film 30 and the leader 43 will stick to the adhesive tapes 84, with the result that the tapes are drawn between the pinch wheels 73 and 74 and toward the rectangular opening 70 in the vertical baffle 63.

At the same time, with the arm 45 likewise advancing, the teeth of the rack 46 mesh with the larger diameter toothed portion 80 of the second gear 78 of the splicing mechanism 59, which is thus rotated in the direction opposite to the direction of movement of the drawer 12.

Conversely, the first gear 77 and the upper pinch wheel 74 are rotated by the smaller diameter toothed portion 79 to rotate in the same direction as the drawer 12 when it advances with the ends of the film 30 and the leader 43 matched and taped.

Accordingly, the arm 45 and the rack 46 contribute advantageously in decoiling the adhesive tapes 84 from the respective reels 64 and ensuring their correct positions on the opposite sides of the photographic film 30 and the leader 43.

With the splicing operation completed, an appropriate sensor, not illustrated in the drawings, will pilot the operation of the solenoid 66 associated with the cutter device 65, and the adhesive tapes 84 are severed along the lateral edge of the film 30 and leader 43. It will be observed that, during the movement of the drawer 12 into the casing 11, the take-up lugs 54 of the leader 43 are directed between the two pinch rollers 85 and 86 of the loading mechanism 60 serving the developing machine 61, as indicated by the phantom lines in FIG. 2. Throughout this step in which the drawer 12 is introduced, the top roller 86 is in fact held at a distance from the bottom roller 85 by the action of the solenoid 90.

With the drawer 12 inserted and the ends of the film 30 and the leader 43 spliced together, the solenoid 90 will be de-energized, for example switched by the same sensor as that which pilots the operation of the cutter device 65, whereupon the top roller 86 is brought into contact with the bottom roller 85 to feed the leader 43 and the film 30 into the developing machine 61 by way of the communicating port 87.

The loading operation concludes when the trailing end of the film 30 locks fast on emerging from the roll 23. As the film 30 continues to be drawn forward by the pinch rollers 85 and 86, the carriage 34 is subjected to a pulling force sufficient to overcome the force of the return spring 40. The carriage is thus advanced along the transverse track 38 to the point of engaging a microswitch 93 which pilots the operation of the cutter 41 positioned over the end of the track 38. The film 30 is cut by the cutter 41, whereupon the carriage 34 is returned to a position of contact with the rectilinear surface 62 through the action of the spring 40.

Thereafter, the lead screw 15 is set in rotation in the opposite direction and the drawer 12 is returned to its position externally of the casing 11.

It will be noted also that the shuttle 22 can be shaped and dimensioned advantageously to accommodate rolls 23 of the film 30 of different sizes, naturally with all the components envisaged for implementation of the various operations described above being suitable likewise configured. The movement of the shuttle 22, furthermore, instead of being controlled manually as aforementioned, could be controlled automatically using suitable motorized drive means of a conventional type. It will be evident from the foregoing description that photographic film 30 can be loaded into a developing machine 61 by the device 10 according to the invention in a precise and correct manner, without the need for complicated manual interventions on the part of the operator, and, accordingly, the operation of loading the film 30 can be supervised by persons possessing no special skills or by persons without any particular training.

In addition, the device 10 according to the invention is so compact that it can be easily associated with or incorporated into developing machines currently in use.

It will be appreciated that various changes and modifications may be imparted to the invention within the true spirit and scope of protection afforded by the appended claims.

We claim:

1. A device for automatically loading photographic film into a developing machine, said device comprising: an external casing open on one side thereof and defining a port which is to communicate with a developing machine; a drawer slidably mounted to said casing so as to be movable longitudinally into and out of said casing through said one side of the casing, said drawer having a longitudinally extending gap therein open at an end of the drawer closest to said casing, and said drawer including a housing configured to house a roll of photographic film, bar code reading means for reading a bar code on the roll of film, longitudinal guide means and transverse guide means for allowing said housing to be shuttled in longitudinal and transverse directions of the drawer, cutter means for trimming an end of the film, a sheath configured to accommodate a leader, and a toothed member extending in the longitudinal direction of the drawer, said housing, said bar code reading means, said guide means, and said cutter means all being disposed to one side of said longitudinally extending gap, and said sheath and said toothed member being disposed to the other side of said longitudinally extending gap, said sheath being located across said gap from said transverse guide means; a vertically extending baffle mounted in said casing so as to be withdrawable from said casing, said baffle being located at a position corresponding to said longitudinally extending gap so as to enter said gap when said drawer is slid into said casing; adhesive tape dispensing means, supported by said baffle, for dispensing adhesive tape onto opposite sides of matched ends of the film and the leader; gears operatively connected to said adhesive tape dispensing means so as to cause the adhesive tape dispensing means to dispense discrete lengths of the adhesive tape when the gears are rotated, said gears being disposed in said casing at a position at which the gears will be meshed with the toothed member of said drawer when said drawer is slid into said casing whereby said gears will be rotated; cutting means for severing the adhesive tape dispensed by said adhesive tape dispensing means onto the matched ends of the tape and the leader to thereby splice the film; a guide disposed in said casing, said guide cooperating with said housing so as to automatically guide said housing, via said transverse guide means, in the transverse direction of the drawer toward said gap as the drawer is slid into the casing to thereby match an end of the photographic film with an end of the leader in said sheath; feed means, disposed within said casing adjacent said port, for feeding a leader and photographic film spliced thereto through said port out of said casing; control means for actuating said cutter means once said housing has been moved along said transverse guide means under the action of said feed means, to thereby sever said film at the other end thereof opposite to the end spliced to the leader; and return means for returning the housing along said transverse guide means in a direction extending away from said gap once the other end of the film has been cut by said cutter means.

2. A device as in claim 1, wherein the drawer is manually slidable relative to the casing.

3. A device as in claim 1, and further comprising drive means for sliding said drawing longitudinally relative to said casing.

4. A device as in claim 2, wherein the drive means comprises a lead screw mounted rotatably to the casing, a lead nut integrated with the drawer and engaged with said lead screw, a geared motor, and gears connecting said motor to said lead screw.

5. A device as in claim 1, wherein the casing has the shape of a right parallelepiped and the drawer has the shape of a right parallelepiped and further comprising telescopic runners mounting said drawer to said casing.

6. A device as in claim 1, wherein the gap extends longitudinally over a distance corresponding to the length of the vertical baffle.

7. A device as in claim 1, wherein said housing comprises two elements both having an L-shaped cross section, and hinged together along a horizontal axis so as to form a hollow member, and supports and a spring provided within said hollow member to restrain the roll parallel to the longitudinal axis of the drawer, said hollow member defining openings respectively affording a passage to film emerging from the roll and exposing the bar code on the roll.

8. A device as in claim 1, wherein said longitudinal guide means comprises a horizontal shelf extending longitudinally at one side of the drawer, said housing has flanges defining edges at respective sides thereof, and said shelf defines longitudinal channels serving as guides for said flanges.

9. A device as in claim 8, wherein said bar code reading means is an optical device housed in the drawer, and said drawer defines a window adjacent to said longitudinal shelf said optical device being aligned with said window.

10. A device as in claim 8, wherein said transverse guide means comprises a carriage occupying a common plane with the horizontal shelf, and a transverse track extending at right angles from the shelf to the longitudinally extending gap in the drawer, the carriage comprising longitudinal edges defining first channels identical to and aligned with the channels of the shelf and transverse edges defining second channels disposed at right angles to the first channels, said transverse track having corresponding guides to which the second channels are slidably coupled, said carriage also including a wheel rotatable about a vertical axis and located to interact with said guide disposed in the casing, and said return means is a return spring by which the underside of the carriage is anchored to the transverse track.

11. A device as in claim 10, wherein said cutter means is situated at an inner end of the transverse track adjacent to the longitudinally extending gap in the drawer, and comprises a first fixed blade, a second blade mounted pivotably in relation to the first blade, and an electromagnetic device operatively connected to said second blade so as to pivot said second blade relative to said first blade.

12. A device as in claim 10, wherein said sheath extends transversely to the longitudinal axis of the drawer and coaxial with the transverse track, and further comprising stops which ensure correct positioning of the leader in the sheath and a proximity sensor positioned to detect whether the leader has been correctly inserted in the sheath.

13. A device as in claim 1, wherein said drawer defines a longitudinal ridge, and said toothed member is a horizontal arm projecting from the longitudinal ridge, the underside of said horizontal arm having teeth so as to form a rack, and the free end of said horizontal arm extending toward the casing in such a way that one of the gears connected to said adhesive tape dispensing means is engaged by the rack as the drawer is inserted into the casing.

14. A device as in claim 13, wherein the vertical baffle defines therein a rectangular opening, and a slot extending longitudinally from an outermost vertical edge of the baffle, and at a right angle to said edge, to said rectangular opening, and said adhesive tape dispensing means comprises two reels of adhesive tape rotatably mounted to said vertical baffle about respective horizontal axes, and upper and lower pinch wheels disposed one above the other at a location between the slot and the rectangular opening, said pinch wheels being rotatable about respective horizontal axes, the lower wheel being freely rotatable about a fixed axis, and further comprising a rocking lever pivotably mounted to said baffle about a horizontal fulcrum and supporting the upper pinch wheel of an end of the lever, and a spring tensioning said upper pinch wheel in such a direction that the upper wheel remains firmly in contact with the lower wheel, and wherein said gears are connected to the upper wheel so as to rotate the upper wheel, said gears being located on a side of the baffle opposite the side on which said pinch wheels are located, adhesive tape from said reels extending over said pinch wheels such that when the drawer is slid into the casing, the matched ends of the film and the leader are caused to enter the slot defined by the baffle, the gears are engaged by the rack of the drawer, and adhesive tape is caused by the pinch wheels to uncoil from the respective reels and to be applied to both sides of the matched ends of the photographic film and the leader, and wherein the vertical baffle also supports said cutting means.

15. A device as in claim 10, wherein the guide disposed in said casing comprises an element projecting from a vertical wall of the casing at a location that will be adjacent to the longitudinal shelf of the drawer when the drawer is in said casing, the element of said guide having an initial portion extending gradually inward from said vertical wall to afford a surface extending obliquely to the longitudinal direction in which the drawer is slidable and a contiguous rectilinear portion affording a surface disposed parallel to the vertical wall of the casing, such that when the drawer is slid into the casing, the wheel of the carriage contacts the oblique surface and the carriage itself is shifted forcibly along the transverse track against the action of the return spring to a location at which a leading end of the film is matched to a tail end of the leader emerging from the sheath.

16. A device as in claim 1, wherein said feed means comprises top and bottom horizontal pinch rollers positioned one above the other alongside the port, the top roller being freely rotatable about a movable axis, a geared motor, gears connecting the bottom roller with said geared motor, and a solenoid coupled to the top roller, said solenoid being actuatable to move the axis of rotation of the top roller between a feed position in which the top roller impinges the bottom roller, and a standby position in which the top roller is elevated from the bottom roller in order to allow take-up lugs of the leader to pass between mutually opposed peripheral surfaces of the two rollers as the drawer is slid into the casing.

17. A device for automatically loading photographic film into a developing machine, said device comprising: an external casing open on at least one side thereof and defining a port in another side thereof extending at a right angle to said one side; a drawer slidably mounted to said casing so as to be movable longitudinally relative to said casing through said one side of the casing, said drawer having a longitudinally extending gap therein, and said drawer including a shuttle configured to house a roll of photographic film therein, said shuttle defining an opening through which an end of the film can be withdrawn when the roll of film is housed in said housing, a longitudinally extending guide to which said shuttle is slidably mounted, said longitudinally extending guide having an inner end closest to said casing, a cutter located alongside said longitudinally extending guide so as to trim the end of the film drawn through the opening of said shuttle, said transverse guide extending from the inner end of said shelf toward said gap in the drawer so as to guide said shuttle toward said gap, and a sheath disposed across said gap from an end of said transverse guide, said sheath having open opposite ends and being configured to hold a leader in a position in which a tail end of the leader projecting from one end of the sheath will be located over said gap so as to be matchable with a leading end of the film once the shuttle is slid toward the gap via said transverse guide; an adhesive tape dispenser disposed in said casing at a position corresponding to said gap; a guide surface located in said casing at a position at which the guide surface will force said shuttle in a transverse direction so as to slide toward said gap via the transverse guide as said drawer is slid into the casing; and feed rollers disposed in said casing alongside said port at a location corresponding to the other end of said sheath such that a take-up end of the leader projecting from the other end of the sheath will be received by said feed rollers once said drawer has been slid into said casing.

* * * * *